US008516836B2

(12) United States Patent
McMasters et al.

(10) Patent No.: US 8,516,836 B2
(45) **Date of Patent: *Aug. 27, 2013**

(54) SYSTEM AND METHOD FOR ACCURATELY RECHARGING AN AIR CONDITIONING SYSTEM

(75) Inventors: Mark McMasters, Owatonna, MN (US); William Brown, Owatonna, MN (US)

(73) Assignee: Service Solutions U.S. LLC, Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/599,324

(22) Filed: Aug. 30, 2012

(65) Prior Publication Data

US 2012/0324922 A1 Dec. 27, 2012

Related U.S. Application Data

(63) Continuation of application No. 12/850,129, filed on Aug. 4, 2010, now Pat. No. 8,272,227.

(51) Int. Cl.
*F25B 45/00* (2006.01)

(52) U.S. Cl.
USPC ..... 62/77; 62/149; 62/272

(58) Field of Classification Search
USPC ..... 62/77, 149, 272, 208, 129, 125, 126, 62/228.3
See application file for complete search history.

(56) References Cited

U.S. PATENT DOCUMENTS

| | | | | |
|---|---|---|---|---|
| 2,741,099 | A * | 4/1956 | Beane | 62/126 |
| 4,364,234 | A * | 12/1982 | Reed | 62/3.3 |
| 4,470,265 | A | 9/1984 | Correia | |
| 4,938,031 | A | 7/1990 | Manz et al. | |
| 5,172,562 | A | 12/1992 | Manz et al. | |
| 5,320,162 | A * | 6/1994 | Seaman | 165/255 |
| 5,377,493 | A | 1/1995 | Friedland | |
| 5,501,076 | A * | 3/1996 | Sharp et al. | 62/3.6 |
| 5,537,835 | A * | 7/1996 | Roth | 62/149 |
| 5,540,254 | A | 7/1996 | McGowan et al. | |
| 5,606,862 | A | 3/1997 | Peckjian et al. | |
| 5,661,978 | A * | 9/1997 | Holmes et al. | 62/3.6 |
| 5,704,223 | A * | 1/1998 | MacPherson et al. | 62/3.62 |
| 5,906,106 | A | 5/1999 | Brown et al. | |
| 5,970,721 | A | 10/1999 | Kamimura et al. | |
| 6,065,294 | A * | 5/2000 | Hammerstedt et al. | 62/3.3 |
| 6,202,433 | B1 | 3/2001 | Murray et al. | |
| 6,259,067 | B1 * | 7/2001 | Faries et al. | 219/428 |
| 6,259,356 | B1 * | 7/2001 | Tamaoki et al. | 340/309.7 |

(Continued)

FOREIGN PATENT DOCUMENTS

EP 2136164 A1 12/2009

OTHER PUBLICATIONS

European Search Report for EP 11176246.4, dated Jun. 4, 2012.

*Primary Examiner* — Mohammad M Ali
(74) *Attorney, Agent, or Firm* — Baker & Hostetler LLP

(57) ABSTRACT

A method of adding refrigerant to an air conditioning system. The method includes measuring a first pressure inside of the air conditioning system and a second pressure inside of a container that holds refrigerant being added to the air conditioning system. The method also includes comparing the difference between the two measured pressures to empirical data in order to determine how long to pulse additional refrigerant into the air conditioning system. In addition, an apparatus configured to add refrigerant to an air conditioning system.

20 Claims, 4 Drawing Sheets

(56) References Cited

U.S. PATENT DOCUMENTS

| | | | | |
|---|---|---|---|---|
| 6,338,255 | B1 | 1/2002 | Richard et al. | |
| 6,408,637 | B1 | 6/2002 | Hanson et al. | |
| 6,467,283 | B1 * | 10/2002 | Trachtenberg | 62/149 |
| 6,699,230 | B2 * | 3/2004 | Jaafar et al. | 604/508 |
| 6,872,362 | B2 * | 3/2005 | Schmidt et al. | 422/63 |
| 6,952,931 | B2 | 10/2005 | Beatenbough et al. | |
| 7,174,742 | B2 | 2/2007 | Thomas et al. | |
| 7,254,954 | B2 | 8/2007 | Govekar et al. | |
| 7,785,868 | B2 * | 8/2010 | Yuan et al. | 435/306.1 |
| 2006/0101834 | A1 | 5/2006 | Govekar et al. | |
| 2009/0114309 | A1 | 5/2009 | Sakai et al. | |
| 2009/0158756 | A1 | 6/2009 | Brown et al. | |
| 2011/0132017 | A1 * | 6/2011 | Kim et al. | 62/259.2 |

* cited by examiner

SYSTEM AND METHOD FOR ACCURATELY RECHARGING AN AIR CONDITIONING SYSTEM

CROSS-REFERENCE TO RELATED APPLICATIONS

This application claims priority to and is a continuation of U.S. patent application Ser. No. 12/850,129, filed Aug. 4, 2010, entitled "System and Method for Accurately Recharging An Air Conditioning System," the disclosure of which is hereby incorporated by reference in its entirety.

FIELD OF THE INVENTION

The present invention relates generally to methods for charging and/or recharging air conditioning systems. The present invention also relates generally to devices and/or systems for charging and/or recharging air conditioning systems.

BACKGROUND OF THE INVENTION

Air conditioning systems are currently commonplace in homes, office buildings and a variety of vehicles including, for example, automobiles. Over time, the refrigerant included in these systems gets depleted and/or contaminated. As such, in order to maintain the overall efficiency and efficacy of an air conditioning system, the refrigerant included therein may be periodically replaced or recharged.

Currently available processes for recharging air conditioning systems typically include placing refrigerant in a recharging unit, connecting the recharging unit to an air conditioning (A/C) system and transferring the refrigerant from the recharging unit to the A/C system. In order to estimate how much refrigerant has been transferred to the A/C system, the recharging unit typically includes a refrigerant containing vessel that is weighed before and after some refrigerant has been transferred to the air conditioning. Although this process is effective for many applications, the process is relatively time-consuming in that several transfers are typically required and refrigerant within the recharging unit has to be given time to settle after each transfer before an accurate weight measurement can be made. Also, currently available processes and recharging units are limited in accuracy because the same amount of refrigerant is typically added with each transfer (i.e., fine-tuning of the amount added is not available when the recharging process is close to having added a desired amount of refrigerant).

SUMMARY OF THE INVENTION

At least in view of the above, it would be desirable to provide novel methods of charging and/or recharging air conditioning systems with greater speed and/or accuracy. It would also be desirable to provide novel devices and/or systems capable of implementing such methods and of thereby providing such benefits.

The foregoing needs are met, to a great extent, by one or more embodiments of the present invention. According to one such embodiment, a method of adding refrigerant to an air conditioning system is provided. The method includes obtaining a recommended amount of refrigerant for the air conditioning system. The method also includes adding a first amount of refrigerant to the air conditioning system. The method further includes measuring, with a first sensor, a first refrigerant pressure of the refrigerator tank and with a second sensor, a second refrigerant pressure within the air conditioning system. In addition, the method also includes determining a second amount of refrigerant to add to the air conditioning system based upon the first refrigerant pressure and the second refrigerant pressure.

In accordance with another embodiment of the present invention, an apparatus to add refrigerant to an air conditioning system is provided. The apparatus includes a container configured to store the refrigerant. The apparatus also includes a valve configured to transfer a first amount of the refrigerant from the container to the air conditioning system. The apparatus also includes a first pressure sensor configured to determine a first pressure of the container and a second pressure sensor configured to determine a second pressure of the air conditioning system. In addition, the apparatus also includes a controller configured to obtain the first pressure from the first pressure sensor and the second pressure from the second pressure sensor and determine a second amount of refrigerant to add to the air conditioning system based upon the first refrigerant pressure and the second refrigerant pressure, wherein the controller further controls the valve and determines the first amount of refrigerant.

In accordance with yet another embodiment of the present invention, another apparatus configured to add refrigerant to an air conditioning system is provided. The apparatus includes means for determining a first amount of refrigerant for the air conditioning system. The apparatus also includes means for adding the first amount of refrigerant and a second amount of refrigerant from a refrigerant container to the air conditioning system, wherein the first amount of refrigerant is less than the second amount of refrigerant. The apparatus also includes first means for measuring a first refrigerant pressure within the refrigerant container and second means for measuring a second refrigerant pressure within the air conditioning system. In addition, that apparatus includes means for determining the second amount of refrigerant based upon the first refrigerant pressure and the second refrigerant pressure.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
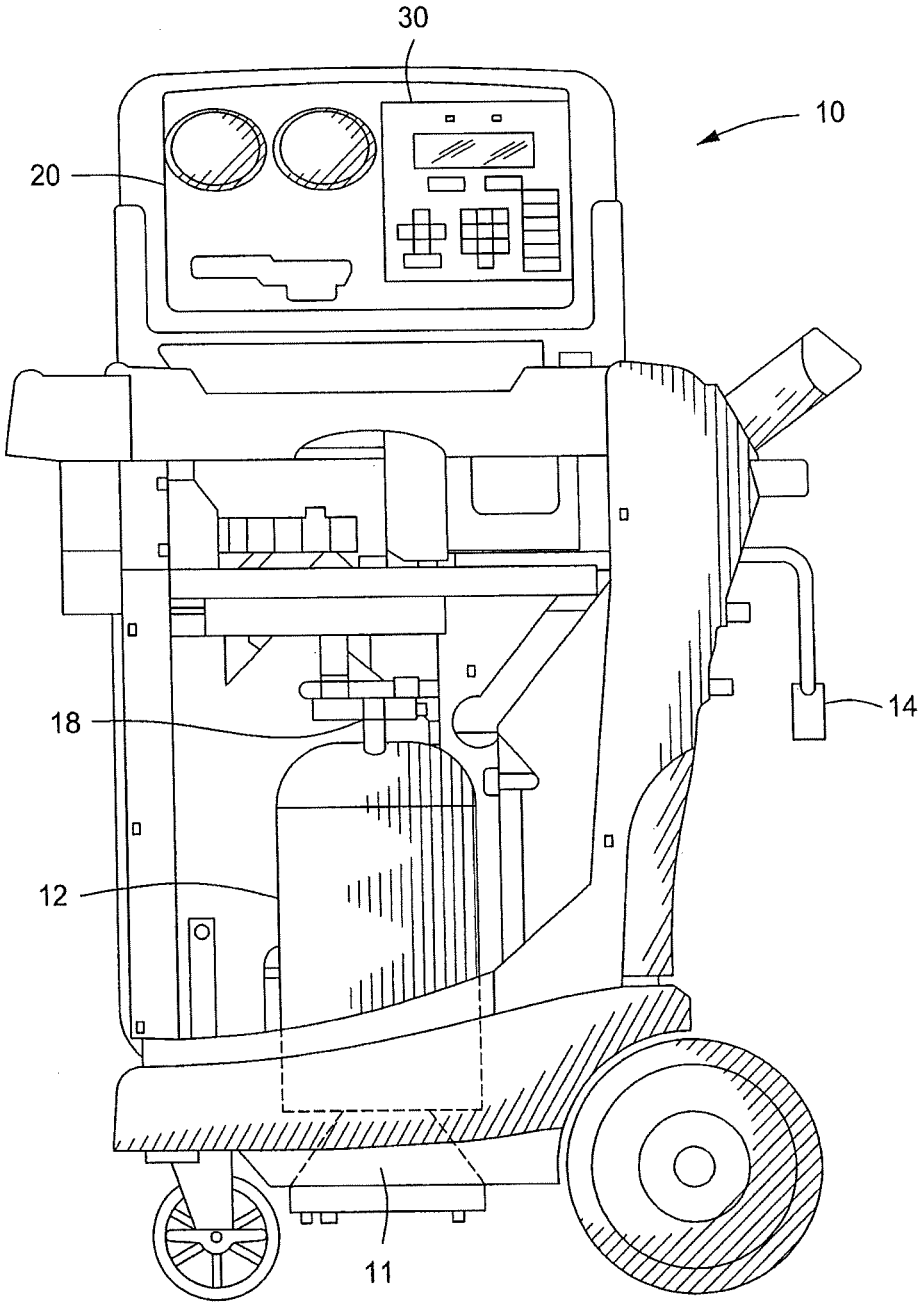
FIG. 1 is an illustration of an air conditioning recharging system according to one embodiment of the present invention.

The invention will now be described with reference to the drawing figures, in which like reference numerals refer to like parts throughout. FIG. 1 is an illustration of an apparatus configured to add refrigerant to an A/C system (i.e., an air conditioning charging and/or recharging system 10) according to one embodiment of the present invention. As illustrated in FIG. 1, the recharging system 10 includes a container 12 that is configured to store the refrigerant. No limitations are placed on the kind of refrigerant that may be used according to the present invention. As such, any refrigerant that is commonly available (e.g., R-134a) may be stored within the container 12. However, according to certain embodiments of the present invention, the container 12 is particularly configured to accommodate refrigerants that are commonly used in the A/C systems of vehicles (e.g., cars, trucks, boats, planes, etc.).

Figure 2:
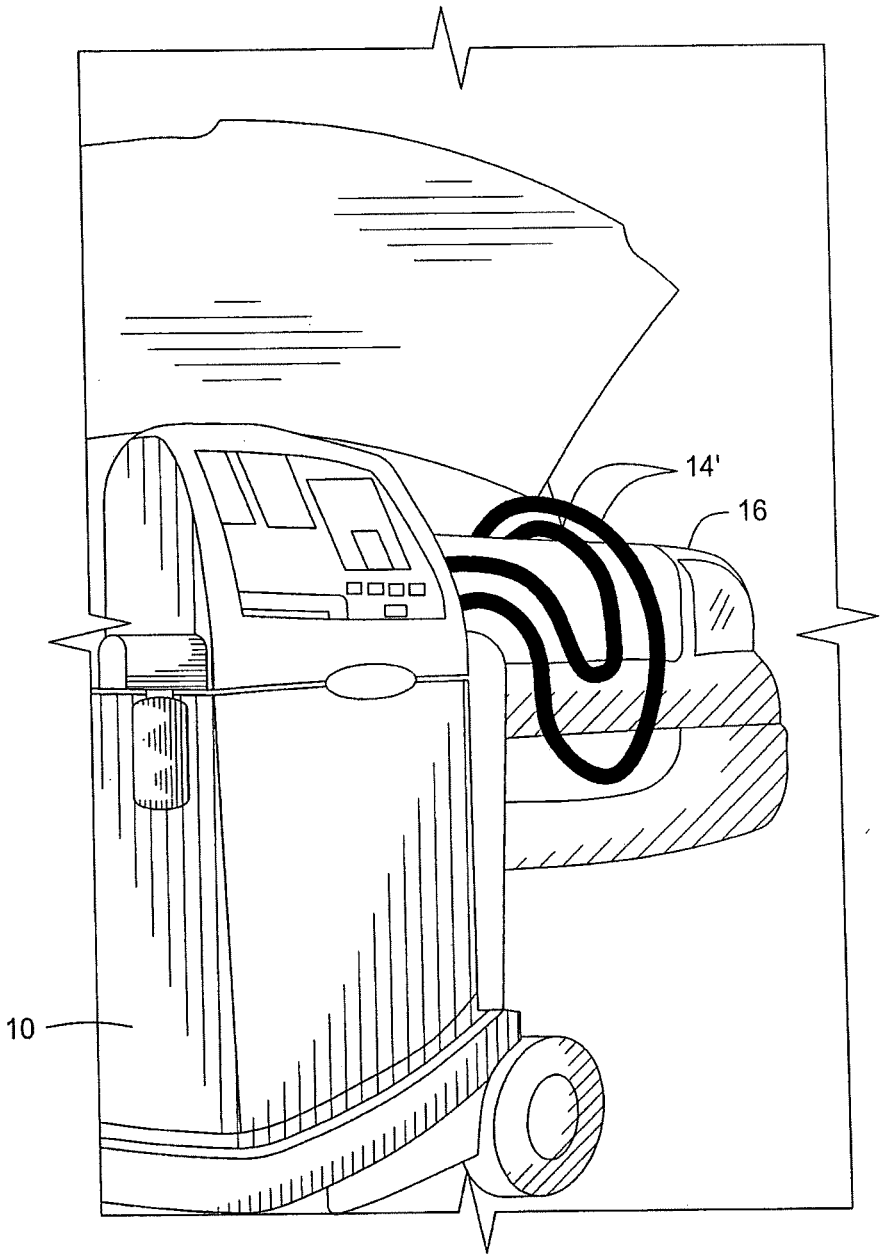
FIG. 2 is an illustration of the air conditioning recharging system illustrated in FIG. 1 as connected to a vehicle.

The above-discussed charging/recharging system 10 also includes a connection mechanism 14 that is configured to facilitate transfer of the refrigerant from the container 12 to the A/C system. FIG. 2 is an illustration of the air conditioning recharging system 10 illustrated in FIG. 1 as it is connected to a vehicle 16 and, more specifically, as it is connected to an automobile. As illustrated in FIG. 2, the connection system 14 may include and/or be extended by one or more hoses 14'. According to certain embodiments of the present invention, each of these hoses 14' is connected to (i.e., engaged with) the recharging system 10 on one end thereof and to an inlet or/and outlet port of the A/C system of the vehicle 16 on another end thereof.

As illustrated in FIG. 1, the recharging system 10 also includes a pressure sensor 18 that is configured to determine and/or monitor the pressure within the container 12. In addition, as also illustrated in FIG. 1, a controller 20 is included in the recharging system 10. The controller 10, according to certain embodiments of the present invention, is electronically connected to and configured to obtain a pressure reading (i.e., a pressure) from the pressure sensor 18 discussed above. Also, the representative controller 20 illustrated in FIG. 1 is further configured to obtain a pressure reading from within the A/C system to which the recharging system 10 is connected. As will be discussed in more detail shortly, the pressure reading from within the air conditioning system may be obtained from a sensor that is either located within, temporarily connected to or permanently connected to the air conditioning system.

The controller 20, according to certain embodiments of the present invention, is also configured to control the connection mechanism 14 and, thereby, to control how much refrigerant flows from the container and to the A/C system. For example, the controller 20 may be configured to actual a solenoid valve included within the connection mechanism 14, thereby either allowing or restricting flow of refrigerant through each of the hoses 14' illustrated in FIG. 2.

In addition the above functionalities, the controller 20, according to certain embodiments of the present invention, is also configured to determine a supplemental amount of refrigerant to be added to the A/C system. As will be discussed in more detail below, such a determination may be made, for example, based upon the refrigerant pressures obtained from within the container 12 and A/C system.

Figure 3:
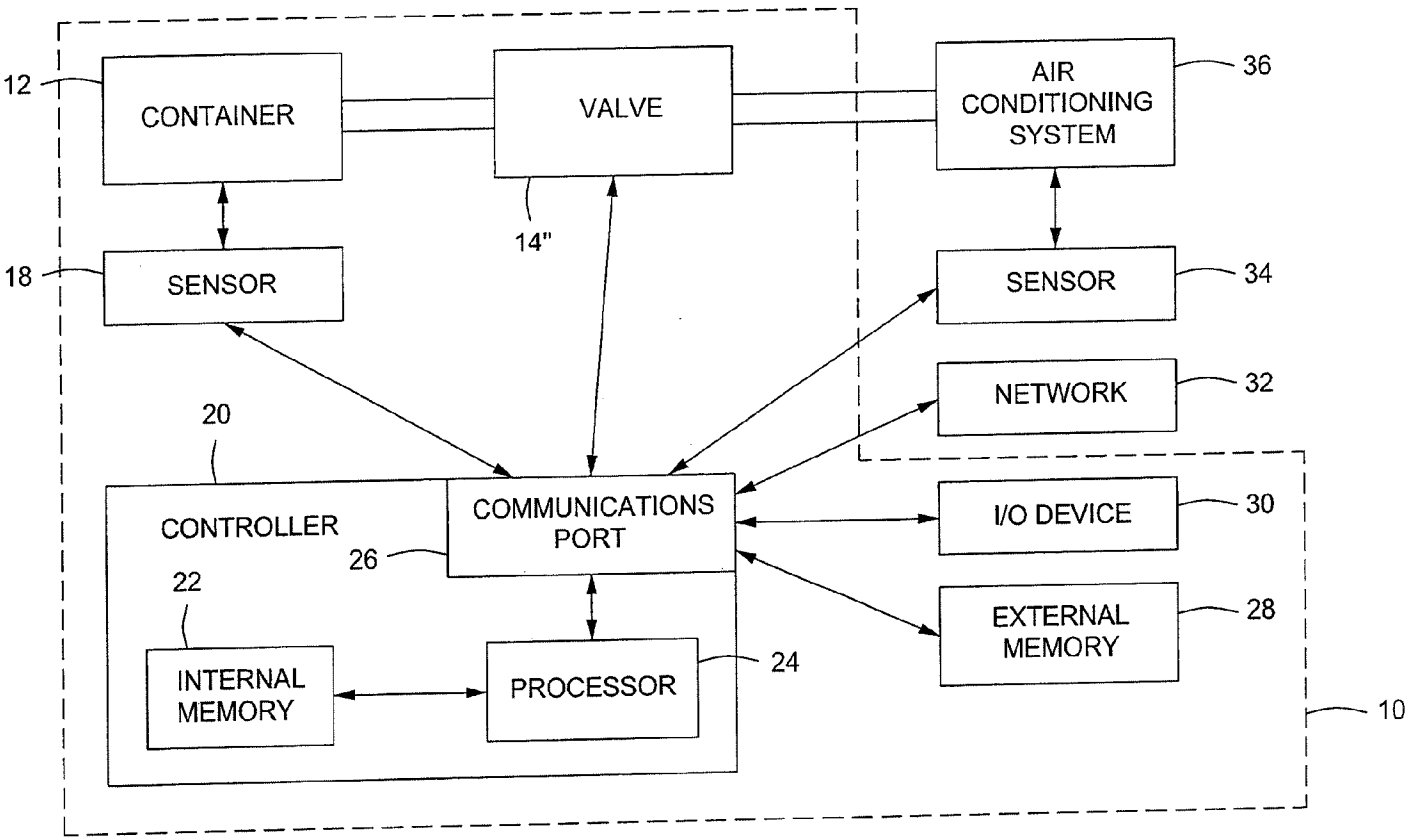
FIG. 3 is a schematic diagram of some components included within and/or that may be connected to the air conditioning recharging system illustrated in FIGS. 1 and 2.

FIG. 3 is a schematic diagram of some components included within and/or that may be connected to the air conditioning recharging system 10 illustrated in FIGS. 1 and 2. FIG. 3 illustrates that the controller 20, according to certain embodiments of the present invention, includes an internal memory 22, a processor 24 and a communications port 26. The representative communications port 26 illustrated in FIG. 3 is also connected to an external memory 28, an input/output (I/O) device 30, a network 32, the previously discussed pressure sensor 18 that monitors pressure in the container 12 and a second pressure sensor 34 that is connected to and monitors pressure in an A/C system 36. Also illustrated in FIG. 3 is a valve 14" (e.g., a solenoid valve) that, according to certain embodiments of the present invention, is either included within or connected to the connection mechanism 14 illustrated in FIG. 2. When the recharging system 10 illustrated in FIG. 3 is in operation, the valve 14" may be opened and shut by the controller 20.

Either or both of the memories 22, 28 illustrated in FIG. 3 may be configured to store empirical data about how much refrigerant should be added to an A/C system based upon relative pressures of a refrigerant-containing enclosure (e.g., container 12) and the A/C system. Also, either or both memories 22, 28 may allow the processor 24 to access such data when the controller 20 is in the process of determining a supplemental amount of refrigerant to be added to the A/C system 36. More information about the empirical data and its use will be provided during the discussion of methods according to the present invention provided below.

The sensor 34 illustrated in FIG. 3 is, according to certain embodiments of the present invention, connected to both the controller 20 and the A/C system 36. Depending on the embodiment, the sensor 34 may be either entirely or only partially contained within the A/C system 36. According to certain other embodiments of the present invention, the sensor 34 is connected to the controller 20 and a computer or computing system that is at least partially controlling a portion of the A/C system 36. For example, when the vehicle 16 illustrated in FIG. 2 is an automobile, the sensor 34 may be connected to or may be a part of the automobile's on-board diagnostic (OBD) system. In such instances, the communications port 26 of the controller 20 may receive information from the sensor 34 through a communications port of the OBD system.

The communications port 26 illustrated in FIG. 3, in addition to being electronically connected to the controller 20, is also configured to receive information about recommended amounts of refrigerant to be added to A/C systems and/or to receive empirical data collected at remote locations. Many manufacturers of A/C system such as the above-discussed system 36 publish the recommended amount of refrigerant to be included in their A/C systems for optimal operation. As such, the communications port 26 may be configured to receive information about the recommended amount from an input device used by an operator of the recharging system 10 reading a manufacturer's publication. For example, the I/O device 30 illustrated in FIG. 1 in the form of a keypad may be used and a mechanic or technician may pick up a manufacturer's handbook and type in the value of the recommended amount. This value may be stored in memory or directly used by a processor.

According to certain other embodiments of the present invention, the communications port 26 is configured to receive remotely collected empirical data and/or the information about the recommended refrigerant amount from an electronic source. According to some such embodiments, an A/C system manufacturer, for example, publishes information about optimal refrigerant amounts on a web site, computer-readable disc or other electronic media. Also, a recharging system manufacturer may publish empirical data in a similar format for a variety of A/C systems and/or refrigerants and/or environmental conditions. Then, empirical data and/or information about one or more of the optimal amounts is, for example, downloaded to the internal memory 22 of the controller 20 from the network 32, which may be an intranet, the Internet or some other electronic network. As an alternative, information from a disc or other electronic network may be transferred directly to the controller 20 when the I/O device 30 takes the form of a CD or DVD reader/writer. Once a sufficient amount of data has been imported, the system 10 may be used to charge or recharge an A/C system.

Figure 4:
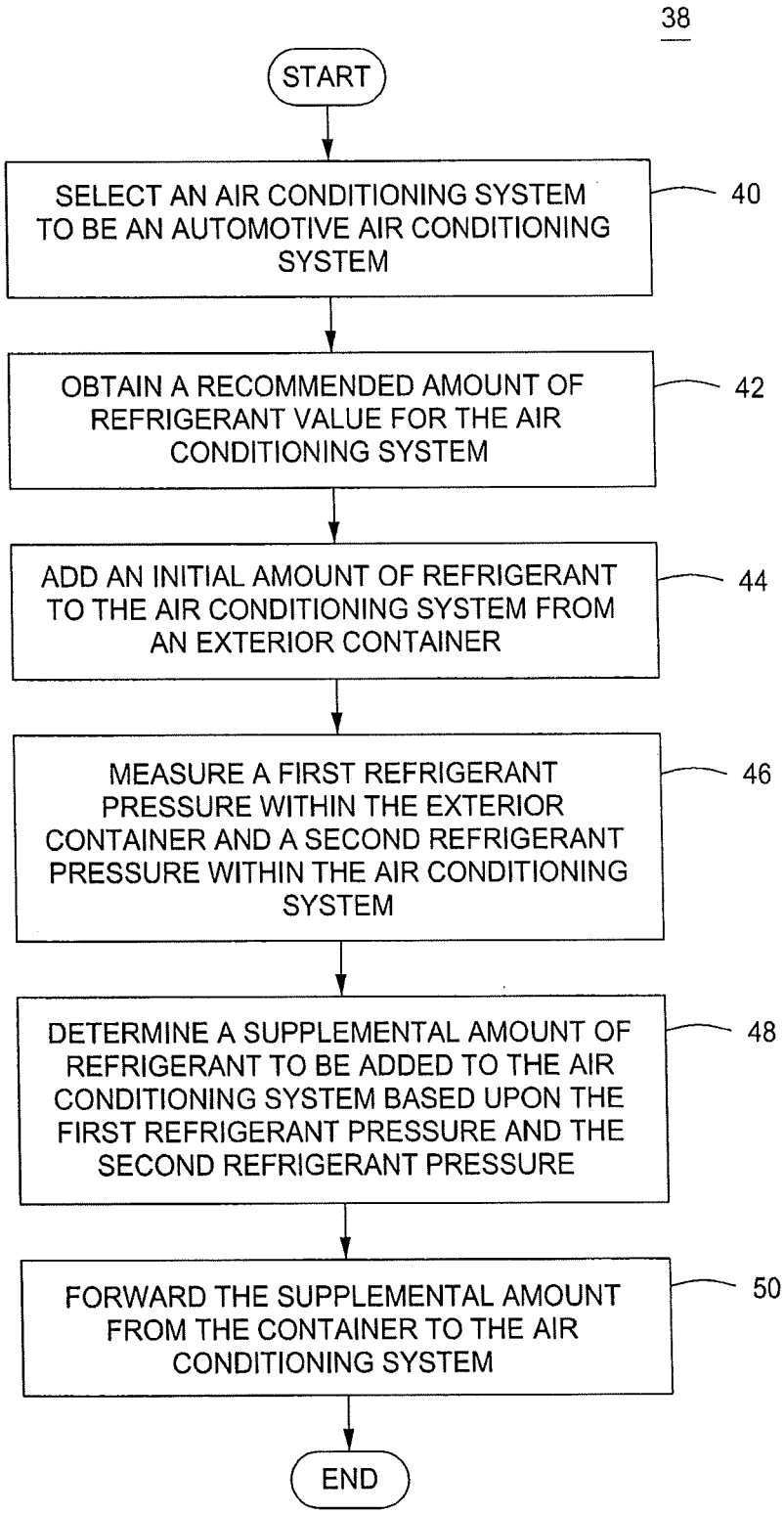
FIG. 4 is a flowchart illustrating steps of a method of charging an air conditioning system according an embodiment of the present invention.

FIG. 4 is a flowchart 38 illustrating the steps of a method of adding refrigerant to an air conditioning system according an embodiment of the present invention. As illustrated in FIG. 4, step 40 of the flowchart 38 specifies selecting an A/C system (e.g., the A/C system 36 illustrated in FIG. 3) to be an automotive air conditioning system. However, other types of A/C systems are also within the scope of the present invention, including those in residential or commercial buildings, planes, farm machinery, etc.

Step 42 next specifies obtaining a recommended amount of refrigerant value for the air conditioning system in question. According to certain embodiments of the present invention, step 42 includes obtaining the recommended amount of refrigerant value (e.g., how much refrigerant is recommended to be added to the A/C system to achieve optimal performance) from at least one of the following sources: a manufacturer of the air conditioning system (e.g., via telephone or from a sales representative); a technical publication; an operation manual for the air conditioning system; an electronic source (e.g., a web site or a piece of computer-readable media); and a marking on the air conditioning system (e.g., a sticker affixed to the system and providing manufacturing and/or operational details).

The next step in flowchart 38 is step 44, which specifies adding an initial amount of refrigerant to the air conditioning system from an exterior container (i.e., a container that is not part of the A/C system being recharged). Step 44 may be implemented, for example, by using the controller 20 to open the valve 14", thereby allowing refrigerant to flow from the container 12 to the A/C system 36.

Typically, in order to prevent overflow of refrigerant in the A/C system, the initial amount of refrigerant added during step 44 is less than the manufacturer's recommended amount for optimum operation. When implementing step 44 using the recharging system 10 discussed above, after connecting the recharging system 10 to the A/C system 36, the valve 14" is typically opened for a relatively long period of time. This allows a relatively large amount of refrigerant to enter the A/C system 36 and for the total amount of refrigerant in the A/C system 36 to be relatively close to the manufacturer's recommended amount when the valve 14" is closed again.

According to certain embodiments of the present invention, the initial adding step 44 includes selecting the initial amount of refrigerant to be added to be within 1% of the recommended amount of refrigerant value. In addition, according to some of these embodiments, the initial adding step 44 includes selecting the initial amount of refrigerant to be added to be within 25 grams of the recommended amount of refrigerant value. In order to determine how much refrigerant has been added to the A/C system, the container 12 may be placed on a scale 11 as illustrated in FIG. 1 and weighed before and after refrigerant has been added to the A/C system. Also, flow meters and/or of any other device or system that would become apparent to one of skill in the art to use upon practicing the present invention may be used to implement step 44 in FIG. 4. It should be noted that when the scale 11 is used, charge accuracy is improved by pausing after each charge of refrigerant has been added as this allows for refrigerant in the container 12 to settle and for a more accurate weight reading to be taken.

Step 46 of the flowchart specifies measuring a first refrigerant pressure within the exterior container and a second refrigerant pressure within the A/C system. When implementing step 46 using the above-discussed A/C charging/recharging system 10, the pressure sensors 18, 34 may be used to obtain the pressures in question. Since the sensor 34 may be part of a vehicle's larger system (e.g., an automobile's OBD system), according to certain embodiments of the present invention, step 46 may include obtaining the second refrigerant pressure from a computer that is at least partially controlling a portion of the air conditioning system. In contrast, step 46 may include obtaining the second refrigerant pressure from a removable sensor that is connected to the air conditioning system while the method is implemented. According to such embodiments, the sensor 34 may be a part of the recharging system 10 and may be inserted in or connected to the A/C system 36 when the recharging system 10 is connected to the A/C system 36.

After step 46 has been conducted, step 48 specifies determining a supplemental amount of refrigerant to be added to the air conditioning system based upon the first refrigerant pressure and the second refrigerant pressure. Then, step 50 specifies forwarding the supplemental amount from the container 12 to the air conditioning system, which ends the charging/recharging method (i.e., process) illustrated in FIG. 4.

According to certain embodiments of the present invention, the above-mentioned step 48 includes determining the supplemental amount of refrigerant based upon empirical data. More specifically, once the pressures inside of the refrigerant container and A/C system are known, a table such as the representative table included below may be used to determine how much more refrigerant should be added to the A/C system. For example, according to the table below, if the pressure in the A/C system is 30 PSI and the pressure in the refrigerant container is 70 PSI, 24 grams of refrigerant is added to the A/C system during

| | 10 PSI (A/C System) | 20 PSI | 30 PSI | 40 PSI |
|---|---|---|---|---|
| 50 PSI (Ref. Cont.) | 22 g. | 15 g. | 8 g. | 3 g. |
| 60 PSI | 27 g. | 22.5 g. | 15 g. | 8 g. |
| 70 PSI | 32 g. | 29 g. | 24 g. | 15 g. |
| 80 PSI | 42 g. | 33 g. | 29.5 g. | 25 g. |

The data in the table presented above may be collected, for example, by a recharging system manufacturer who charges and recharges a variety of A/C systems using a variety of recharging systems according to the present invention at different times of year, elevations, geographic locations, temperatures, with different refrigerants, etc. As will become apparent to one of skill in the art upon practicing the present invention, tables such as the table presented above will be different for different recharging system configurations, A/C systems, refrigerants, connection systems, etc. As such, the table presented above is merely illustrative in nature. Also, because a large amount of empirical data may be stored in the memory of a single recharging system, tables according to the present invention may be numerous, multidimensional and/or very large. In other words, such table may allow a user to specify a number of parameters (e.g., where the test is being conducted, the temperature in the auto repair shop where the recharging is being conducted, the type of refrigerant used, etc.).

The above method, by using tables such as the one included above, accounts for, among other things, how much refrigerant gets "trapped" in the hoses, valves, etc., positioned between a particular recharging unit and a given A/C system. Also, by calling for the addition of more refrigerant when the pressure difference between the A/C system and container is larger, the A/C system may be filled with a satisfactory amount of refrigerant with as few as two charges (i.e., the initial and supplemental additions illustrated as steps 44 and 50). In fact, if a sufficient amount of refrigerant is already in an A/C system before a recharging system is connected thereto, the initial addition of refrigerant may sometimes be skipped and a single addition of refrigerant, based upon the above-mentioned pressure difference, may be enough to fully recharge the A/C system.

According to certain embodiments of the present invention, one or both of the adding and forwarding steps (i.e., steps 44 and 50) is implemented by successively adding or forwarding incremental amounts of refrigerant. For example, the forwarding step 50 may be implemented by weighing the container 12 and opening the valve 14" for a defined (and usually brief) period, thereby allowing some refrigerant to flow from the container 12 to the air conditioning system 36. Then, pursuant to an optional time period that allows refrigerant in the container 12 to settle, the container 12 is reweighed. Based on the difference in weight prior and pursuant to the valve 14" having been opened, the amount of refrigerant transferred may be determined. Then, if more refrigerant is to be added, this process may be repeated until enough refrigerant has been added to the A/C system 36.

At least in view of the above, methods/processes according to the present invention can be performed more efficiently than previously available charging/recharging processes/methods that use multiple iterations of refrigerant addition. Further, because system- and/or environment-specific empirical data may used, a greater degree of accuracy may be achieved, when compared to merely adding the same amount of refrigerant time and time again until an amount close to the satisfactory amount has been added.

One example of an implementation of a method of adding refrigerant to an A/C system according to the present invention will now be discussed. According to this example, a recommended amount of refrigerant value for an automotive A/C system is found in a manufacturer's catalog to be 2.0 pounds. As such, 1.8 pounds (i.e., a value close to but below the recommended amount) of refrigerant is forwarded from the refrigerant container of a recharging system. However, because refrigerant gets trapped, for example, in the hoses between the container and the A/C system, only 1.7 pounds of is actually added to the A/C system. Once the pressures in the container and A/C system are determined, a chart is used to determine that 0.3 pounds of additional refrigerant should be added. As such, 0.3 additional pounds of refrigerant are forwarded from the container to the A/C system and, since very little refrigerant loss expected since the hoses were already filled during the initial addition, the refrigerant addition is considered to be complete.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of adding refrigerant to an air conditioning system, the method comprising the steps of:

obtaining a recommended amount of refrigerant for the air conditioning system;

adding a first amount of refrigerant from a refrigerant tank to the air conditioning system;

measuring, with a first sensor, a first refrigerant pressure of the refrigerant tank and with a second sensor, a second refrigerant pressure within the air conditioning system; and determining a second amount of refrigerant to add to the air conditioning system based upon the first refrigerant pressure and the second refrigerant pressure.

2. The method of claim 1, further comprising the step of:

selecting the air conditioning system to be an automotive air conditioning system.

3. The method of claim 1, wherein the obtaining the recommended amount of refrigerant is from at least one of a manufacturer of the air conditioning system, a technical publication, an operation manual for the air conditioning system, an electronic source and a marking on the air conditioning system.

4. The method of claim 1, wherein the first amount of refrigerant is within 1% of the recommended amount of refrigerant.

5. The method of claim 1, wherein the first amount of refrigerant is within 25 grams of the recommended amount of refrigerant.

6. The method of claim 1, wherein the second sensor is controlled by a computer in a vehicle.

7. The method of claim 2, wherein adding the second amount of refrigerant is done after a predetermined amount of time has passed from adding of the first amount of refrigerant.

8. The method of claim 2, wherein the first and second amounts of refrigerant are determined based upon empirical data.

9. The method of claim 1 further comprising the step of selecting the air conditioning system.

10. An apparatus to add refrigerant to an air conditioning system, the apparatus comprising:

a container configured to store the refrigerant;

a valve configured to transfer a first amount of the refrigerant from the container to the air conditioning system;

a first pressure sensor configured to determine a first pressure of the container;

a second pressure sensor configured to determine a second pressure of the air conditioning system; and a controller configured to obtain the first pressure from the first pressure sensor and the second pressure from the second pressure sensor and determine a second amount of refrigerant to add to the air conditioning system based upon the first refrigerant pressure and the second refrigerant pressure, wherein the controller further controls the valve and determines the first amount of refrigerant.

11. The apparatus of claim 10, wherein the controller controls the valve to transfer the determined second amount of refrigerant from the container to the air conditioning system.

12. The apparatus of claim 10 further comprising:

a memory configured to store empirical data and allow the controller to access the empirical data when the controller determines the first and second amounts of refrigerant to be added.

13. The apparatus of claim 10, wherein the first amount of refrigerant is greater than the second amount of refrigerant.

14. The apparatus of claim 10, further comprising:

a communications port electronically connected to the controller and configured to receive information about first and second amounts of refrigerant.

15. The apparatus of claim 14, wherein the communications port is configured to receive the information about the first and second amounts of refrigerant from an input device used by an operator of the apparatus.

16. The apparatus of claim 14, wherein the communications port is configured to receive the information about the first and second amounts of refrigerant from an electronic source.

17. An apparatus configured to add refrigerant to an air conditioning system, the apparatus comprising:

means for determining a first amount of refrigerant for the air conditioning system;

means for adding the first amount of refrigerant and a second amount of refrigerant from a refrigerant container to the air conditioning system, wherein the first amount of refrigerant is less than the second amount of refrigerant;

first means for measuring a first refrigerant pressure within the refrigerant container; and second means for measuring a second refrigerant pressure within the air conditioning system wherein the means for determining also determines the second amount of refrigerant based upon the first refrigerant pressure and the second refrigerant pressure.

18. The apparatus of claim 17, wherein the means for determining determines the first and second amounts of refrigerant based upon empirical data.

19. The apparatus of claim 17, wherein the means for adding is configured to successively add incremental amounts of refrigerant and to pause between additions of the incremental amounts.

20. The apparatus of claim 17, wherein the means for determining controls the means for adding.

* * * * *